US009431706B2

(12) United States Patent
Chang et al.

(10) Patent No.: US 9,431,706 B2
(45) Date of Patent: Aug. 30, 2016

(54) MULTI-BAND ANTENNA

(71) Applicant: Acer Incorporated, New Taipei (TW)

(72) Inventors: Kun-Sheng Chang, New Taipei (TW); Ching-Chi Lin, New Taipei (TW); Ming-Yu Chou, New Taipei (TW)

(73) Assignee: Acer Incorporated, New Taipei (TW)

( * ) Notice: Subject to any disclaimer, the term of this patent is extended or adjusted under 35 U.S.C. 154(b) by 161 days.

(21) Appl. No.: 14/295,357

(22) Filed: Jun. 4, 2014

(65) Prior Publication Data

US 2015/0042517 A1 Feb. 12, 2015

(30) Foreign Application Priority Data

Aug. 6, 2013 (TW) ..... 102128118 A

(51) Int. Cl.
*H01Q 1/24* (2006.01)
*H01Q 5/385* (2015.01)
*H01Q 5/371* (2015.01)

(52) U.S. Cl.
CPC ..... *H01Q 5/385* (2015.01); *H01Q 5/371* (2015.01)

(58) Field of Classification Search
CPC ..... H01Q 5/371; H01Q 5/385
USPC ..... 343/700 MS, 702, 829, 846
See application file for complete search history.

(56) References Cited

U.S. PATENT DOCUMENTS 7,489,278 B2 * 2/2009 Huang ..... H01Q 9/0421 343/700 MS
8,643,558 B2 * 2/2014 Tseng ..... H01Q 9/145 343/749
9,099,766 B2 * 8/2015 Chan ..... H01Q 9/42
2005/0128151 A1 * 6/2005 Kwak ..... H01Q 1/243 343/702
2007/0069958 A1 3/2007 Ozkar
2007/0285321 A1 * 12/2007 Chung ..... H01Q 1/38 343/702
2015/0200448 A1 * 7/2015 Tsai ..... H01Q 1/243 343/702

FOREIGN PATENT DOCUMENTS

CN 101114733 1/2008
EP 2521217 11/2012

OTHER PUBLICATIONS

Li et al., "Internal penta-band printed loop-type mobile phone antenna," IEEE Region 10 Conference, Oct. 30-Nov. 2, 2007, pp. 1-4.

* cited by examiner

*Primary Examiner* — Tho G Phan
(74) *Attorney, Agent, or Firm* — Jianq Chyun IP Office

(57) ABSTRACT

A multi-band antenna including a ground plane, a radiation element, a first extension element and a second extension element is provided. The radiation element includes a first portion and a second portion electrically connected with each other. The first portion has a feeding point. The first and the second extension elements are extended from the ground plane. The first extension element and the first portion are spaced by a first coupling distance. The second extension element and the second portion are spaced by a second coupling distance. The multi-band antenna is operated in a first band through the radiation element. A feeding signal from the radiation element excites the first and the second extension elements through the first and the second coupling distances so that the multi-band antenna is operated further in a second band and a third band.

9 Claims, 5 Drawing Sheets

MULTI-BAND ANTENNA

CROSS-REFERENCE TO RELATED APPLICATION

This application claims the priority benefit of Taiwan application serial no. 102128118, filed on Aug. 6, 2013. The entirety of the above-mentioned patent application is hereby incorporated by reference herein and made a part of this specification.

BACKGROUND OF THE INVENTION

1. Field of the Invention

The invention relates to an antenna, and more particularly, to a multi-band antenna.

2. Description of Related Art

In recent years, various wireless communication devices, such as smartphones, tablet PCs, personal wireless navigation systems, portable players and so on, tend to incorporate all known communication functions, instead of performing only a single wireless communication function. In addition, to reduce a hardware space of a device, these wireless communication devices adopt a single wireless communication chip that supports multiple wireless communication functions in various communication protocols such as wireless fidelity (WiFi), global positioning system (GPS), Bluetooth (BT) and so on.

With regard to corresponding antennas, current wireless communication devices usually require multiple antennas (e.g. WiFi antenna, GPS antenna, etc.) to be embedded therein in order to support the various wireless communication functions. However, as the embedded antennas are increased, more hardware space in the wireless communication devices is consumed for disposing the antennas, which limits the miniaturization of the wireless communication devices. In addition, for purposes of enhancing radiation efficiency or gain of antenna, in current design of antennas, laser direct structuring (LSD) technology or iron element is often utilized to form an antenna having an irregular three-dimensional structure. However, such design still requires larger hardware space for disposing the antenna.

SUMMARY OF THE INVENTION

The invention provides a multi-band antenna that generates coupling effects respectively with two extension elements through a radiation element, so as to generate multiple resonant modes and to support multiple communication functions.

The multi-band antenna of the invention includes a ground plane, a radiation element, a first extension element and a second extension element. The radiation element includes a first portion and a second portion electrically connected with each other. The first portion is adjacent to an edge of the ground plane and has a feeding point. The first extension element is extended from the edge of the ground plane and is spaced from the first portion by a first coupling distance. The second extension element is extended from the edge of the ground plane and is spaced from the second portion by a second coupling distance. The multi-band antenna is operated in a first band through the radiation element. A feeding signal from the radiation element excites the first and the second extension elements through the first and the second coupling distances so that the multi-band antenna is operated further in a second band and a third band.

Based on the above, the multi-band antenna of the invention generates coupling effects respectively with the two extension elements through the radiation element. Accordingly, the multi-band antenna generates multiple resonant modes, and thus is operated in multiple bands and supports multiple communication functions. In an actual application, a wireless communication device only requires a single multi-band antenna to be able to support a wireless communication chip having multiple communication functions. In this way, an effect of reducing hardware space is achieved, thus facilitating miniaturization.

To make the above features and advantages of the invention more comprehensible, embodiments accompanied with drawings are described in detail as follows.

DETAILED DESCRIPTION OF DISCLOSED EMBODIMENTS

Figure 1:
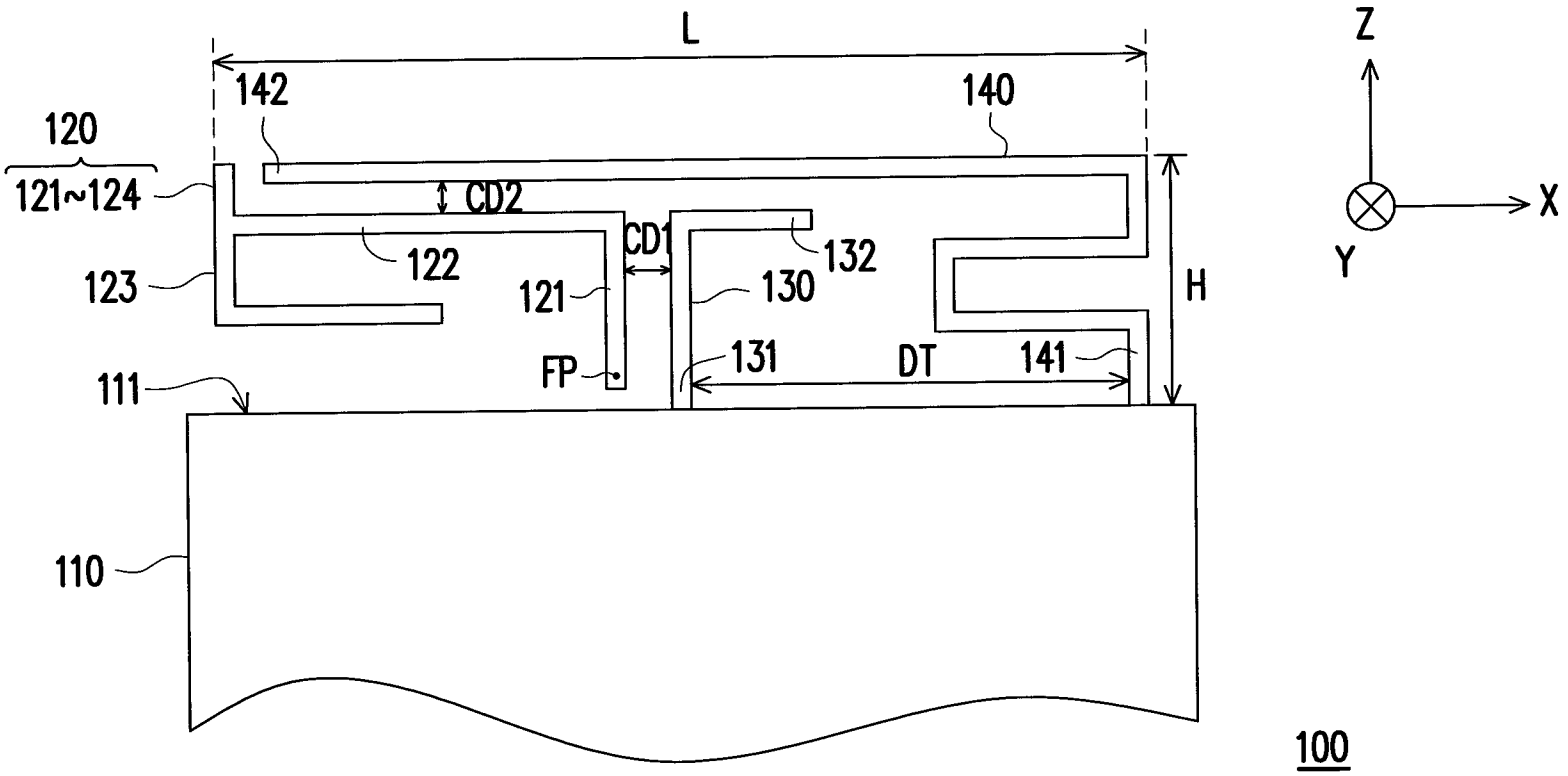
FIG. 1 is a schematic diagram of a structure of a multi-band antenna according to an embodiment of the invention.

FIG. 1 is a schematic diagram of a structure of a multi-band antenna according to an embodiment of the invention. As shown in FIG. 1, a multi-band antenna 100 includes a ground plane 110, a radiation element 120, a first extension element 130 and a second extension element 140. The radiation element 120 includes a first portion 121 and a second portion 122. The first portion 121 is adjacent to an edge 111 of the ground plane 110 and has a feeding point FP. The first portion 121 is electrically connected to the second portion 122. The first extension element 130 and the second extension element 140 are extended from the edge 111 of the ground plane 110. The first extension element 131 and the first portion 121 are spaced by a first coupling distance CD1. The second extension element 140 and the second portion 122 are spaced by a second coupling distance CD2.

In terms of operation, the multi-band antenna 100 receives a feeding signal via the feeding point FP of the radiation element 120. The radiation element 120 is excited by the feeding signal to generate a first resonant mode so that the multi-band antenna 100 is operated in a first band. In addition, the feeding signal from the radiation element 120 excites the first extension element 130 through the first coupling distance CD1 so that the multi-band antenna 100 generates a second resonant mode through the first extension element 130 and is operated further in a second band. Besides, the feeding signal from the radiation element 120 excites the second extension element 140 through the second coupling distance CD2 so that the multi-band antenna 100 generates a third resonant mode through the second extension element 140 and is operated further in a third band.

In other words, the radiation element 120 generates coupling effects respectively with the two extension elements 130 and 140. In this way, the multi-band antenna 100 not only generates a resonant mode through the radiation element 120, but also generates different resonant modes through the two extension elements 130 and 140. Therefore, the multi-band antenna 100 may be operated in multiple bands so as to support multiple communication functions.

Figure 2:
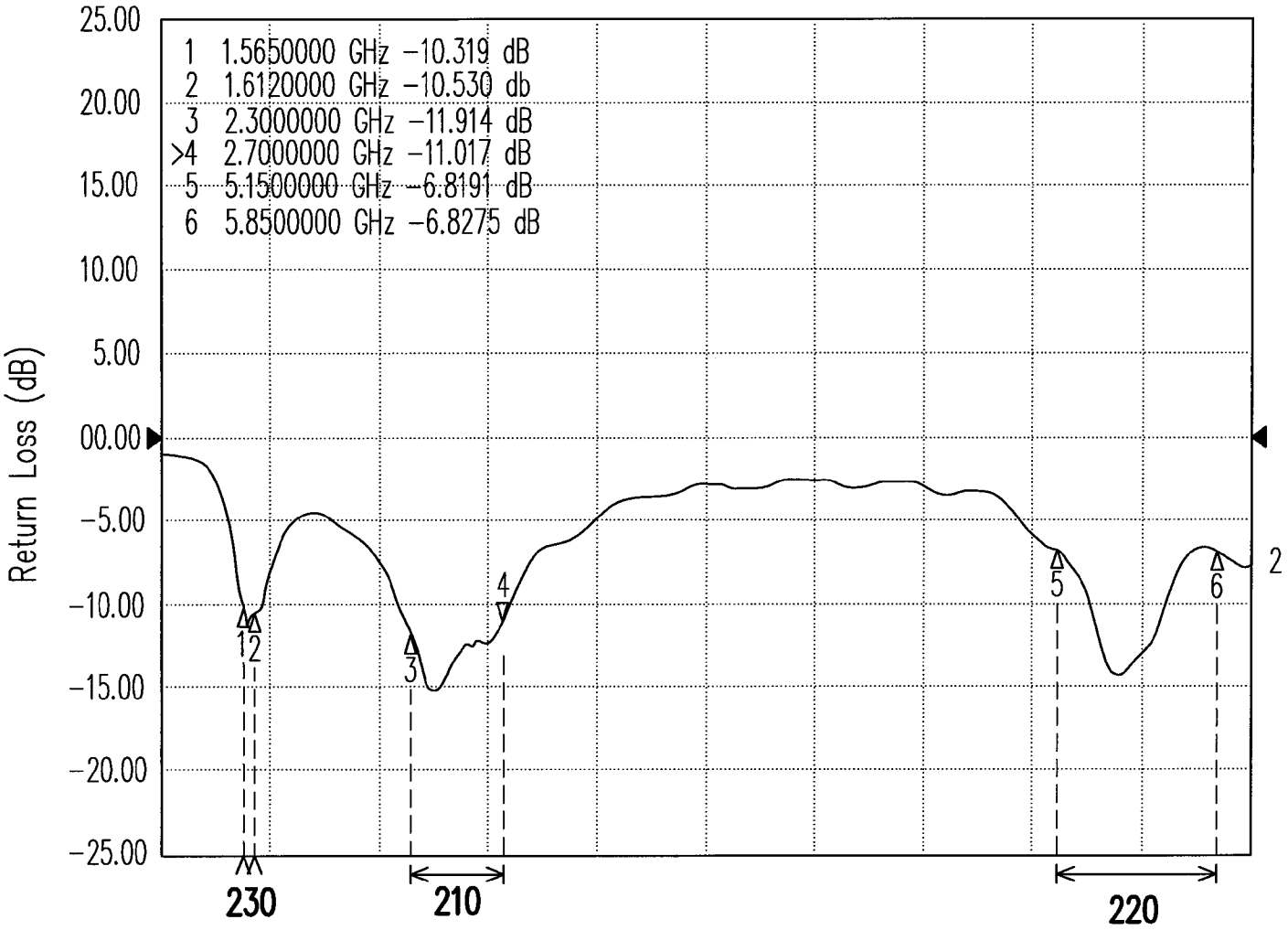
FIG. 2 is a graph showing return loss of a multi-band antenna according to an embodiment of the invention.

FIG. 2, for example, is a graph showing return loss of a multi-band antenna according to an embodiment of the invention. As shown in FIG. 2, in the present embodiment, the radiation element 120, the first extension element 130 and the second extension element 140 are equivalent to an antenna element. The antenna element has a length L and a height H of respectively 26 mm and 6 mm. In addition, the multi-band antenna 100 may be operated in a first band 210, a second band 220 and a third band 230. Moreover, the first band 210 covers a frequency band range (2300-2700 MHz) for 2G, the second band 220 covers a frequency band range (5150-5875 MHz) for 5G, and the third band 230 covers a frequency band range (1565-1612 MHz) for the Global Positioning System (GPS) and the GLObal NAvigation Satellite System (GLONASS).

Figure 3:
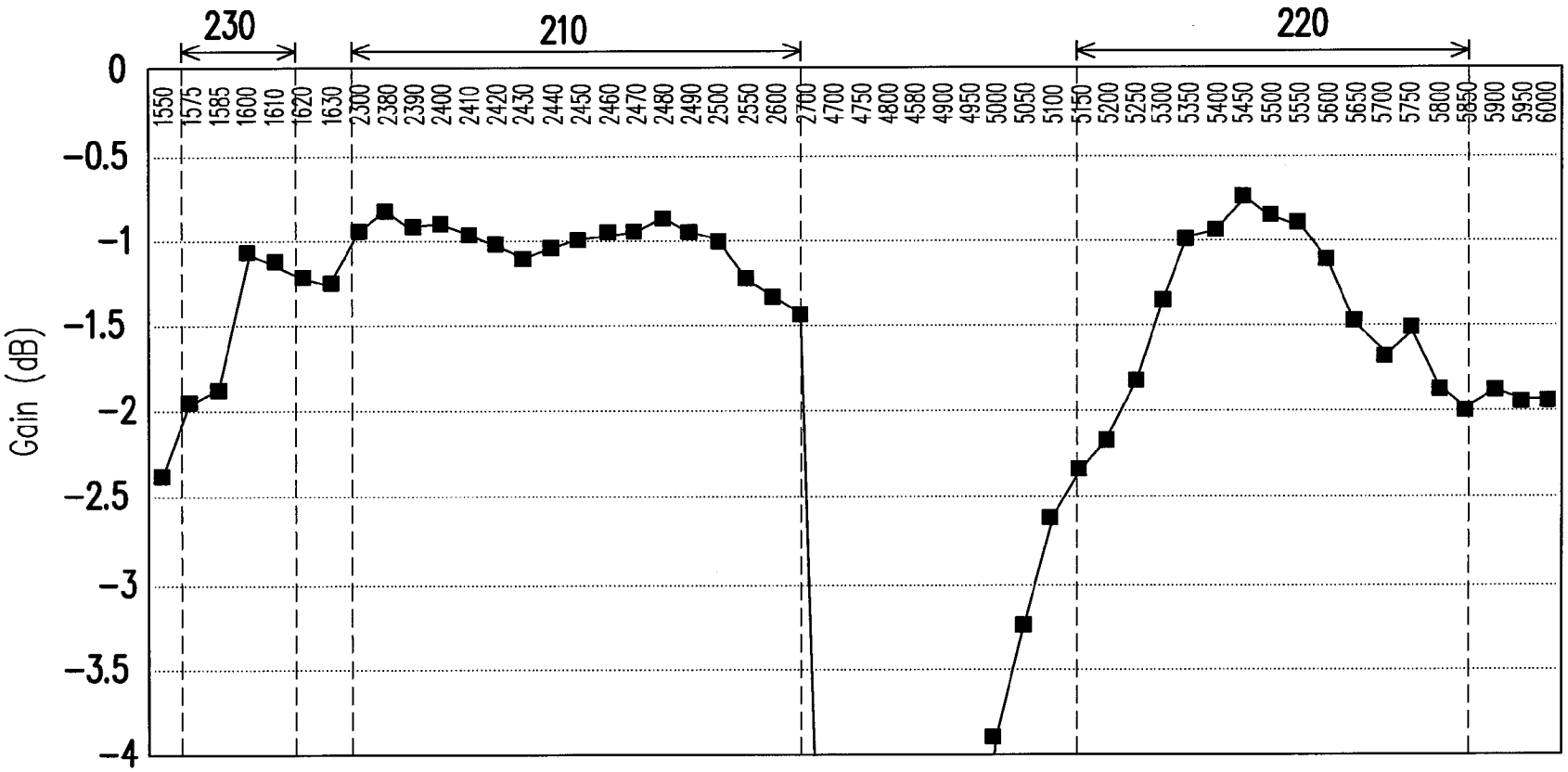
FIG. 3 is a graph showing gain of a multi-band antenna according to an embodiment of the invention.
Figure 4:
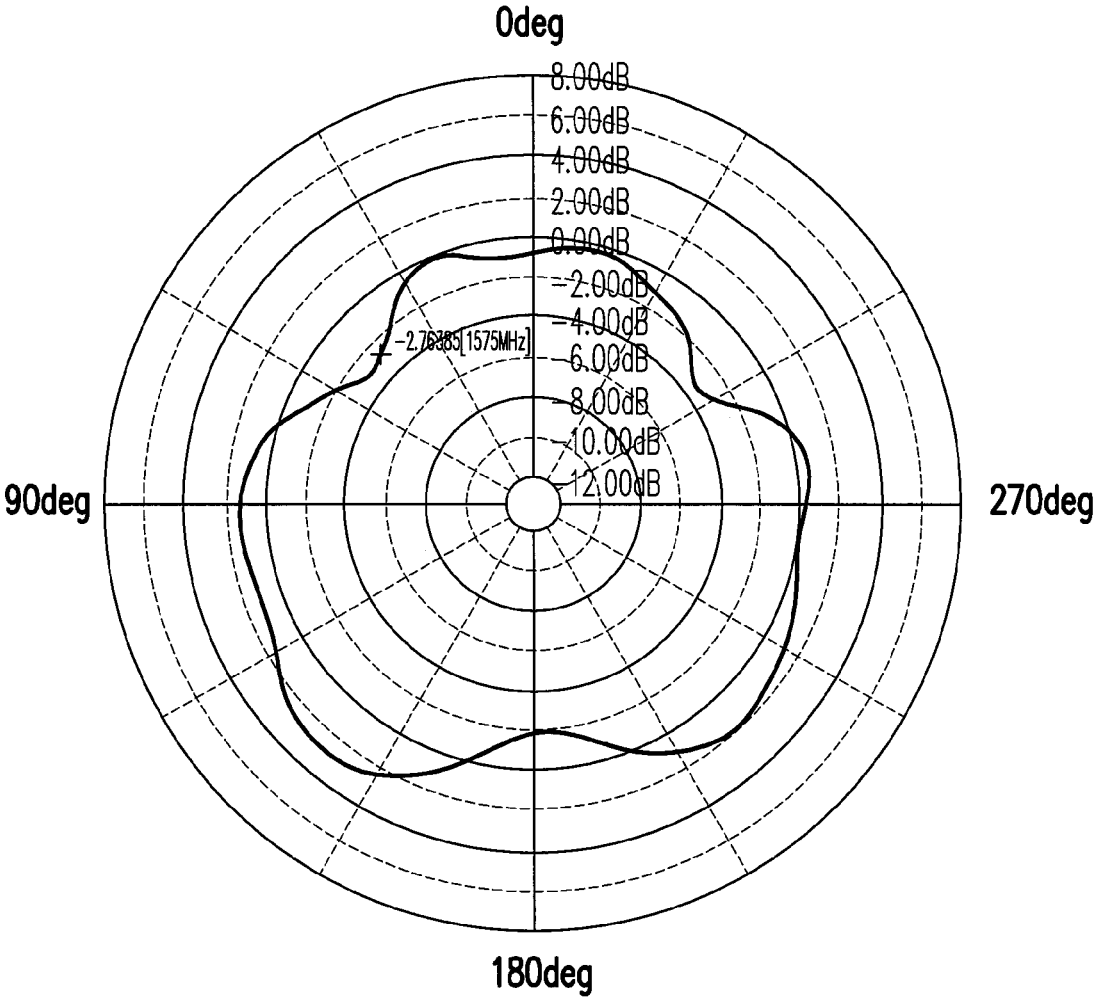
FIGS. 4-5 show patterns of a multi-band antenna according to an embodiment of the invention.
Figure 5:
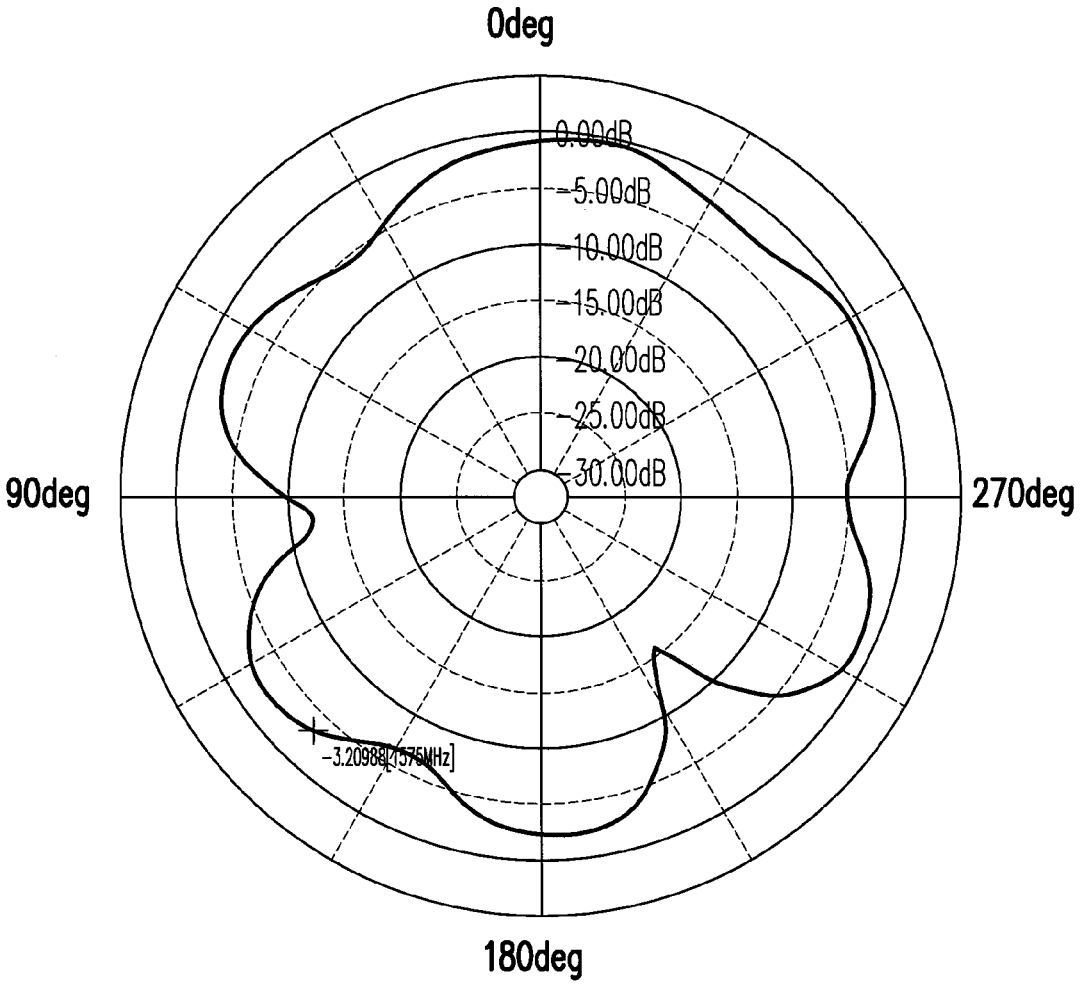

In addition, FIG. 3 is a graph showing gain of a multi-band antenna according to an embodiment of the invention, and FIGS. 4-5 show patterns of a multi-band antenna according to an embodiment of the invention. As shown in FIG. 3, the multi-band antenna 100 has a good antenna gain in all of the first band 210, the second band 220 and the third band 230. Particularly in the first band 210, the multi-band antenna 100 has a gain as high as −1 dB, which means that the multi-band antenna 100 achieves an antenna efficiency of 90%. In addition, FIGS. 4-5 show radiation patterns of the multi-band antenna 100 on Y-Z and X-Z planes in the first band 210. As shown in FIGS. 4-5, the multi-band antenna 100 has an omni-directional radiation pattern in the first band 210, and difference between an upper pattern and a lower pattern of the multi-band antenna 100 is within 1 dB. Accordingly, in real practice, whether the multi-band antenna 100 is disposed on an upper side or a lower side of a wireless communication device, the multi-band antenna 100 is able to receive a GPS signal.

It is to be noted that since the multi-band antenna 100 supports multiple communication functions through multiple resonant modes, only a single multi-band antenna 100 is required to be embedded in the wireless communication device for supporting a wireless communication chip having multiple communication functions. In this way, an effect of reducing hardware space is achieved, thus facilitating miniaturization. In addition, the multi-band antenna 100 is provided with good radiation pattern and gain without use of LDS technology or iron element. Thus the hardware space is reduced even further.

Still referring to FIG. 1, in terms of details of the structure of the multi-band antenna 100, the radiation element 120, the first extension element 130 and the second extension element 140 are arranged in sequence along the edge 111 of the ground plane 110. In addition, a first end 131 of the first extension element 130 is electrically connected to the edge 111 of the ground plane 110, and a second end 132 of the first extension element 130 is an open end. Similarly, a first end 141 of the second extension element 140 is electrically connected to the edge 111 of the ground plane 110, and a second end 142 of the second extension element 140 is an open end. Moreover, the first end 131 of the first extension element 130 is opposite to the first portion 121 of the radiation element 120, and the second end 142 of the second extension element 140 is opposite to the second portion 122 of the radiation element 120.

The first extension element 130 is configured to provide a first resonant path. The first resonant path is from the first end 131 of the first extension element 130 to the second end 132 of the first extension element 130. In addition, the first extension element 130 adopts a quarter wavelength resonance. Hence the first resonant path has a length of approximately one-fourth a wavelength of a lowest frequency in the second band. Similarly, the second extension element 140 is configured to provide a second resonant path. The second resonant path is from the first end 141 of the second extension element 140 to the second end 142 of the second extension element 140. In addition, the second extension element 140 also adopts a quarter wavelength resonance. Hence the second resonant path has a length of approximately one-fourth a wavelength of a lowest frequency in the third band.

In the whole configuration, the first end 131 of the first extension element 130 is adjacent to the first portion 121 of the radiation element 120. A spacing DT between the first end 131 of the first extension element 130 and the first end 141 of the second extension element 140 is larger than one-twentieth the wavelength of the lowest frequency in the third band. The first coupling distance CD1 is between one and two times the wavelength of the lowest frequency in the second band, while the second coupling distance CD2 is between one and two times the wavelength of the lowest frequency in the third band. Meanwhile, in an embodiment, the second extension element 140 further includes at least one bend so as to further reduce the hardware space consumed by the multi-band antenna 100.

Furthermore, the radiation element 120 further includes a third portion 123 and a fourth portion 124. Both the third portion 123 and the fourth portion 124 are electrically connected to the second portion 122. In addition, the third portion 123 is configured to extend the resonant path of the radiation element 120 to meet actual application requirements. The fourth portion 124 is opposite to the second end 142 of the second extension element 140 so as to increase the coupling effect between the radiation element 120 and the second extension element 140. In an embodiment, the ground plane 110, the radiation element 120, the first extension element 130 and the second extension element 140 are located on the same horizontal plane (e.g. X-Z plane). In other words, the multi-band antenna 100 may have a planar structure and may be disposed on a surface of a substrate, such as a printed circuit board or a flexible printed circuit board.

In summary, the multi-band antenna of the invention generates coupling effects respectively with the two extension elements through the radiation element. Accordingly, the multi-band antenna forms multiple resonant modes, and thus may be operated in multiple bands and may support multiple communication functions. In an actual application, a wireless communication device only requires the multi-band antenna to be able to support a wireless communication chip having multiple communication functions. In this way, an effect of reducing hardware space is achieved, thus facilitating miniaturization.

Although the invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. A multi-band antenna, comprising:

a ground plane;

a radiation element comprising a first portion and a second portion electrically connected with each other, wherein the first portion is adjacent to an edge of the ground plane and has a feeding point;

a first extension element extended from the edge of the ground plane and spaced from the first portion by a first coupling distance; and a second extension element extended from the edge of the ground plane and spaced from the second portion by a second coupling distance, wherein the multi-band antenna is operated in a first band through the radiation element, and a feeding signal from the radiation element excites the first and the second extension elements through the first and the second coupling distances so that the multi-band antenna is operated further in a second band and a third band, wherein the radiation element, the first extension element and the second extension element are arranged in sequence along the edge of the ground plane.

2. The multi-band antenna of claim 1, wherein a first end of the first extension element is electrically connected to the edge of the ground plane and is opposite to the first portion, and a second end of the first extension element is an open end.

3. The multi-band antenna of claim 1, wherein a first end of the second extension element is electrically connected to the edge of the ground plane, and a second end of the second extension element is an open end and is opposite to the second portion.

4. The multi-band antenna of claim 1, wherein the first end of the first extension element and the first end of the second extension element are electrically connected to the edge of the ground plane, the first end of the first extension element is adjacent to the first portion, and a spacing between the first end of the first extension element and the first end of the second extension element is larger than one-twentieth a wavelength of a lowest frequency in the third band.

5. The multi-band antenna of claim 1, wherein the first extension element provides a first resonant path, and the first resonant path has a length of one-fourth a wavelength of a lowest frequency in the second band.

6. The multi-band antenna of claim 5, wherein the first coupling distance is between one and two times the wavelength of the lowest frequency.

7. The multi-band antenna of claim 1, wherein the second extension element provides a second resonant path, and a length of the second resonant path is one-fourth a wavelength of a lowest frequency in the third band.

8. The multi-band antenna of claim 7, wherein the second coupling distance is between one and two times the wavelength of the lowest frequency.

9. The multi-band antenna of claim 1, wherein the ground plane, the radiation element, the first extension element and the second extension element are located on the same horizontal plane.

* * * * *